US012789864B2

(12) United States Patent
Cho et al.

(10) Patent No.: US 12,789,864 B2
(45) Date of Patent: Nov. 10, 2026

(54) APPARATUS AND METHOD FOR MEASURING RAILROAD OF TRANSFER VEHICLE

(71) Applicant: SEMES CO., LTD., Cheonan-si (KR)

(72) Inventors: Jae Ik Cho, Cheonan-si (KR); Chungil Cho, Cheonan-si (KR); Chul Hyung Lee, Cheonan-si (KR)

(73) Assignee: SEMES CO., LTD., Cheonan-si (KR)

( * ) Notice: Subject to any disclaimer, the term of this patent is extended or adjusted under 35 U.S.C. 154(b) by 445 days.

(21) Appl. No.: 18/385,193

(22) Filed: Oct. 30, 2023

(65) Prior Publication Data

US 2024/0149927 A1 May 9, 2024

(30) Foreign Application Priority Data

Nov. 8, 2022 (KR) ..... 10-2022-0148290

(51) Int. Cl.
*B61L 5/10* (2006.01)
*B61D 15/12* (2006.01)
*B61L 23/04* (2006.01)

(52) U.S. Cl.
CPC ..... *B61L 5/107* (2013.01); *B61D 15/12* (2013.01); *B61L 23/042* (2013.01)

(58) Field of Classification Search
CPC ..... B61L 5/107; B61L 23/042; B61D 15/12; B61K 9/08; F16M 11/425; G01B 21/02; G01B 21/06; G01B 21/32; H10P 72/0606; H10P 72/3202; H10P 72/3218; H10P 72/3221
See application file for complete search history.

(56) References Cited

U.S. PATENT DOCUMENTS 5,025,566 A * 6/1991 Fiechter ..... E01B 35/02 33/360
5,094,004 A * 3/1992 Wooten ..... G01C 22/02 33/366.26
10,604,899 B2 3/2020 Horii et al.
2018/0100274 A1* 4/2018 Horii ..... B61K 9/08

FOREIGN PATENT DOCUMENTS

KR 10-2018-0040491 4/2018
KR 10-2075705 3/2020
KR 10-2021-0111544 9/2021

OTHER PUBLICATIONS

Office Action from the Korean Intellectual Property Office dated Apr. 24, 2024.

* cited by examiner

*Primary Examiner* — Xin Y Zhong

(57) ABSTRACT

Disclosed herein are an apparatus and method for measuring a railroad of a transfer vehicle to check the installation status of the railroad to ensure that the railroad of the transfer vehicle is installed in accordance with specifications. The apparatus may include a body formed in correspondence with a railroad of the transfer vehicle, a detector provided to the body and arranged in contact with the railroad, and a displacement measurer configured to measure a displacement of the detector in contact with the railroad.

18 Claims, 9 Drawing Sheets

APPARATUS AND METHOD FOR MEASURING RAILROAD OF TRANSFER VEHICLE

CROSS-REFERENCE TO RELATED APPLICATION

This application claims priority to and the benefit of Korean Patent Application No. 10-2022-0148290, filed on Nov. 8, 2022, the disclosure of which is incorporated herein by reference in its entirety.

BACKGROUND

1. Field of the Invention

The present disclosure relates to an apparatus and method for measuring a railroad of a transfer vehicle, and more particularly, to an apparatus and method for measuring a railroad of a transfer vehicle that enables the installation status of the railroad to be checked to ensure that the railroad of the transfer vehicle is installed in accordance with regulations.

2. Description of the Related Art

In order to improve the efficiency of semiconductor manufacturing, techniques for improving various processes (e.g., exposure, deposition, etching, ion implantation, cleaning, etc.) performed by semiconductor manufacturing facilities have been introduced and used, as well as equipment for more effectively transferring items (e.g., a container for storing wafers, a front opening unified pod (FOUP), a reticle pod (POD) for storing reticles, etc.) between semiconductor manufacturing facilities. For example, an item transfer apparatus including an overhead hoist transport (OHT) configured to transfer items while traveling along a transfer path provided on the ceiling side of a semiconductor manufacturing facility has been widely used.

The item transfer apparatus including the OHT may include a travel rail providing a transfer path, a transfer vehicle arranged to travel along the travel rail, and a hoist device arranged under the transfer vehicle. The hoist device may support an item to be transferred, and the hoist may rotate the item, move the item in a horizontal direction, or raise and lower the item in a vertical direction to place the item on an item storage rack.

SUMMARY OF THE DISCLOSURE

However, conventionally, when the railroad of a transfer vehicle is installed for the first time or repaired during use, workers are required to carry various gap gauges, scalers, rulers, etc. separately in addition to a standard stick or reference jig to manually measure the railroad installed on the ceiling in a very uncomfortable posture.

This conventional method of measuring railroads by manual labor is based on reading the scale by hand, and has many problems such as large errors between workers, cumbersome work procedures, and time-consuming work due to uncomfortable postures of workers.

Therefore, the present disclosure has been made in view of various problems including the above problems, and it is an object of the present disclosure to provide an apparatus and method for measuring a railroad of a transfer vehicle that enable the installation status of the railroad to be accurately and quickly measured in a very intuitive and convenient manner using digitized numerical values or a display facilitating identification while mounted on rails and moving along the railroad. However, this object is exemplary and does not limit the scope of the present disclosure.

In accordance with an aspect of the present disclosure, the above and other objects can be accomplished by the provision of an apparatus for measuring a railroad of a transfer vehicle. The apparatus may include a body formed in correspondence with a railroad of the transfer vehicle, a detector provided to the body and arranged in contact with the railroad, and a displacement measurer configured to measure a displacement of the detector in contact with the railroad.

According to the present disclosure, the detector may include a movable member having a contact surface disposed in contact with the railroad, a guide rod having a front end, a middle portion, and a rear end, wherein the front end is provided to the movable member, the middle portion is arranged to move back and forth in a first direction along a guide hole formed in the body, and the rear end is connected to the displacement measurer, and an elastic spring arranged between the movable member and the body to exert an elastic return force in a direction of contact between the movable member and the railroad.

According to the present disclosure, the detector may further include a direction switcher disposed between the guide rod and the displacement measurer and configured to switch movement of the guide rod in the first direction to movement in a second direction different from the first direction.

According to the present disclosure, the direction switcher may include an angled block arranged at the rear end of the guide rod to move with the guide rod, the angled block having an inclined surface formed on one side, a roller arranged in rolling contact with the inclined surface of the angled block, and a displacement measuring rod disposed to rotatably support the roller and connected to the displacement measurer.

According to the present disclosure, the transfer vehicle is a vehicle of an overhead hoist transport (OHT), wherein the railroad may include at least one upper rail corresponding to an upper wheel of the transfer vehicle, at least one left rail corresponding to a left wheel of the transfer vehicle, and at least one right rail corresponding to a right wheel of the transfer vehicle.

According to the present disclosure, the body may include a horizontal member hung on the left rail and the right rail in a substantially horizontal position to measure an installation status of the left rail and the right rail, and a vertical member protruding upward from the horizontal member in a substantially vertical position to measure an installation status of the upper rail.

According to the present disclosure, the detector may include a first detector mounted on the vertical member to contact a side surface of the upper rail to measure an installation status of the side surface of the upper rail, and a second detector mounted on the horizontal member to contact a side surface of the left rail or a side surface of the right rail to measure an installation gap between the left rail and the right rail.

According to the present disclosure, one end of the horizontal member may be provided with a first reference contact surface arranged in close contact with a top surface of the right rail to serve as a reference for height measurement, and a second reference contact surface arranged in close contact with the side surface of the right rail or the left rail to serve as a reference for gap measurement. An opposite end of the horizontal member may be provided with a resting surface resting on a top surface of the left rail or the right rail, wherein the second detector may be disposed on a lower side of the resting surface.

According to the present disclosure, the apparatus may further include a horizontal inclination gauge arranged on the horizontal member and configured to measure an inclination of the horizontal member with respect to a horizontal direction according to an installation height of the left rail or the right rail.

According to the present disclosure, the detector may further include a third detector mounted on the vertical member and disposed to contact a bottom surface of the upper rail to measure an installation status of the bottom surface of the upper rail.

According to the present disclosure, the detector may include a rolling wheel brought into rolling contact with the railroad to enable measurement of movement, a movable member disposed to support the rolling wheel while allowing for free rotation of the rolling wheel, a guide rod having a front end provided to the movable member and a middle portion arranged to move back and forth in a first direction along a guide hole formed in the body, and an elastic spring arranged between the movable member and the body to exert an elastic return force in a direction of contact between the rolling wheel and the railroad.

According to the present disclosure, the detector may further include a direction switcher disposed between the movable member and the displacement measurer to switch movement of the movable member in the first direction into movement in a second direction different from the first direction, wherein the direction switcher may include an angled block arranged on the movable member to move with the movable member, the angled block having an inclined surface formed on one side, a roller arranged in rolling contact with the inclined surface of the angled block, and a displacement measuring rod disposed to rotatably support the roller and connected to the displacement measurer.

According to the present disclosure, one end of the horizontal member of the body may be provided with a first reference wheel arranged in close contact with a top surface of a right rail or a left rail to serve as a reference for height measurement, and a second reference wheel arranged in close contact with a side surface of the right rail or the left rail to serve as a reference for gap measurement, wherein an opposite end of the horizontal member may be provided with a resting wheel resting on the top surface of the left rail or the right rail.

According to the present disclosure, the apparatus may further include a controller configured to compare a value of the displacement measured by the displacement measurer with a reference range and to display the value of the displacement on a display when the value is outside the reference range.

According to the present disclosure, the display may include a below status notifier configured to be activated for ease of visual checking by an operator when the value of the measured displacement is below the reference range, a normal status notifier configured to be activated when the value of the measured displacement is within the reference range, and an over status notifier configured to be activated when the value of the measured displacement is above the reference range.

According to the present disclosure, the apparatus may further include a position sensor configured to sense a position of the railroad contacted by the detector, wherein the controller may match the position sensed by the position sensor with the displacement measured by the displacement measurer.

According to the present disclosure, the position sensor may include one of at least one camera, an identification device configured to identify an identifier on the railroad, including a bar code, a QR code, an RFID, a magnet, or a semiconductor chip, a GPS sensing device, a distance measurement wheel mounted on the body so as to be rollable in contact with the railroad and configured to sense a distance traveled from a reference point based on a diameter and a number of revolutions, a laser rangefinder configured to measure a distance using reflected laser light, or an ultrasonic rangefinder configured to measure a distance using sound waves or ultrasonic waves, or a combination thereof.

In accordance with another aspect of the present disclosure, provided herein is a method of measuring a railroad of a transfer vehicle. The method may include (a) preparing a railroad measurement apparatus for the transfer vehicle, including a body formed in correspondence with a railroad of the transfer vehicle, a detector provided to the body and arranged in contact with the railroad, and a displacement measurer configured to measure a displacement of the detector in contact with the railroad, (b) mounting the railroad measurement apparatus on the railroad to bring at least a portion of the body or the detector into contact with the railroad, (c) measuring first displacement information about the detector at a first point using the displacement measurer, and (d) measuring second displacement information about the detector at a second point by moving the body along the railroad with the body and the detector contacting the railroad.

According to the present disclosure, the measuring of the second displacement information may include moving the body along the railroad using at least one wheel provided to the body.

In accordance with yet another aspect of the present disclosure, provided herein is an apparatus for measuring a railroad of a transfer vehicle. The apparatus may include a body formed in correspondence with a railroad of the transfer vehicle, a detector provided to the body and arranged in contact with the railroad, and a displacement measurer configured to measure a displacement of the detector in contact with the railroad. The detector may include a movable member having a contact surface disposed in contact with the railroad, a guide rod having a front end, a middle portion, and a rear end, wherein the front end may be provided to the movable member, the middle portion may be arranged to move back and forth in a first direction along a guide hole formed in the body, and the rear end may be connected to the displacement measurer, an elastic spring arranged between the movable member and the body to exert an elastic return force in a direction of contact between the movable member and the railroad, and a direction switcher disposed between the guide rod and the displacement measurer and configured to switch movement of the guide rod in the first direction to movement in a second direction different from the first direction. The direction switcher may include an angled block arranged at the rear end of the guide rod to move with the guide rod, the angled block having an inclined surface formed on one side, a roller arranged in rolling contact with the inclined surface of the angled block, and a displacement measuring rod disposed to rotatably support the roller and connected to the displacement measurer. The transfer vehicle may be a transfer vehicle of an overhead hoist transport (OHT). The railroad may include at least one upper rail corresponding to an upper wheel of the transfer vehicle, at least one left rail corresponding to a left wheel of the transfer vehicle, and at least one right rail corresponding to a right wheel of the transfer vehicle. The body may include a horizontal member hung on the left rail and the right rail in a substantially horizontal position to measure an installation status of the left rail and the right rail, and a vertical member protruding upward from the horizontal member in a substantially vertical position to measure an installation status of the upper rail. The detector may include a first detector mounted on the vertical member to contact a side surface of the upper rail to measure an installation status of the side surface of the upper rail, and a second detector mounted on the horizontal member to contact a side surface of the left rail or a side surface of the right rail to measure an installation gap between the left rail and the right rail. One end of the horizontal member may be provided with a first reference contact surface arranged in close contact with a top surface of the right rail to serve as a reference for height measurement, and a second reference contact surface arranged in close contact with the side surface of the right rail or the left rail to serve as a reference for gap measurement. An opposite end of the horizontal member may be provided with a resting surface resting on a top surface of the left rail or the right rail, wherein the second detector may be disposed on a lower side of the resting surface.

BRIEF DESCRIPTION OF THE DRAWINGS

The above and other objects, features and other advantages of the present disclosure will be more clearly understood from the following detailed description taken in conjunction with the accompanying drawings, in which.

DETAILED DESCRIPTION OF THE DISCLOSURE

Figure 1:
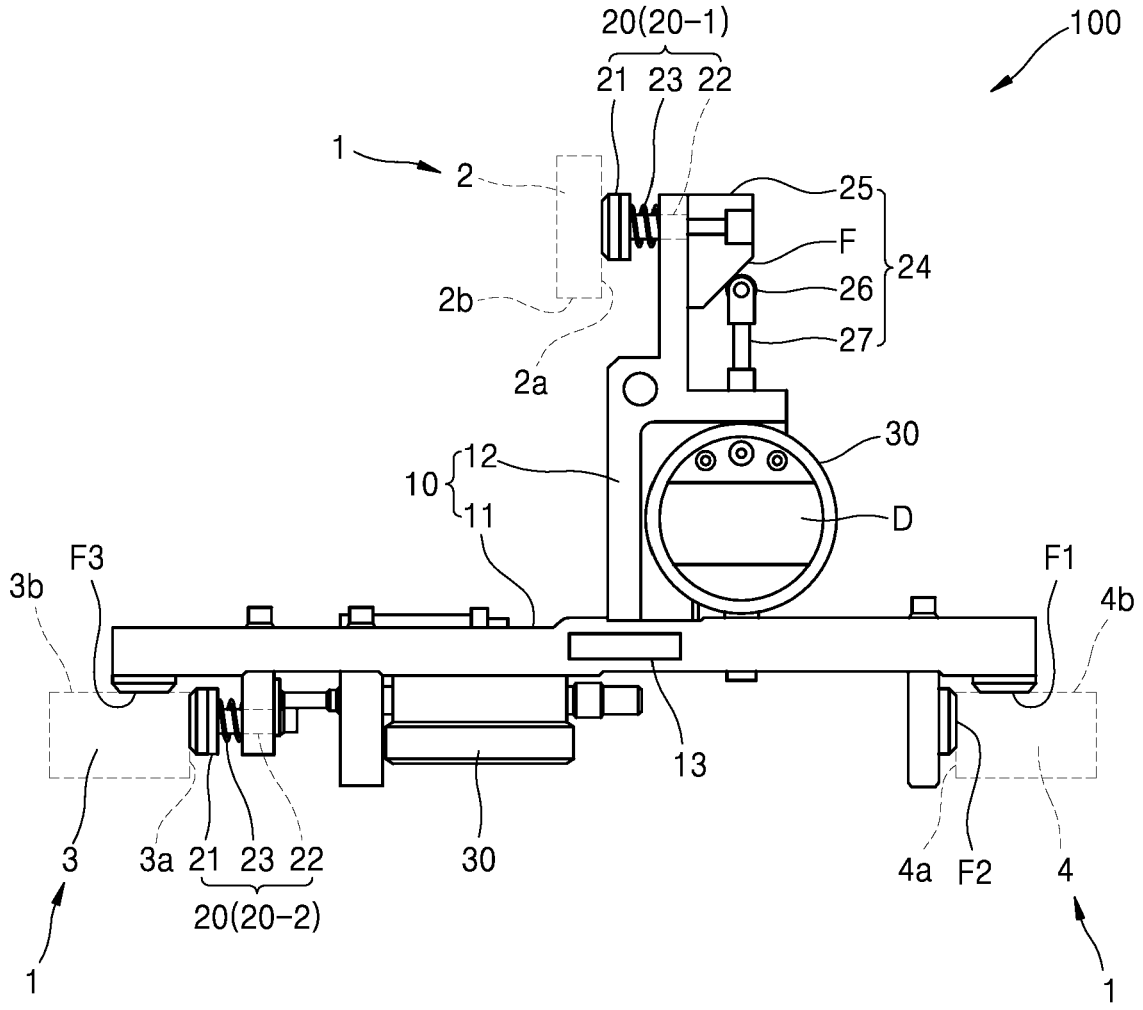
FIG. 1 is a front view showing a railroad measurement apparatus for a transfer vehicle according to some embodiments of the present disclosure.

Hereinafter, several preferred embodiments of the present disclosure will be described in detail with reference to the accompanying drawings.

The embodiments of the present disclosure are provided to provide a thorough understanding of the present disclosure to those skilled in the art. Various modifications may be made to the following embodiments, and the scope of the present disclosure is not limited to the following embodiments. Rather, these embodiments are provided to make the disclosure complete and to fully convey the ideas of the disclosure to those skilled in the art. In addition, the thickness or size of each layer in the drawings is exaggerated for ease of illustration and clarity.

The terms used herein are intended to describe specific embodiments and are not intended to limit the present disclosure. As used herein, the singular form may encompass a plural form, unless the context clearly indicates otherwise. In addition, as used herein, the words "comprise" and/or "comprising" are intended to specify the presence of the mentioned figures, numbers, steps, operations, members, elements, and/or groups thereof, and not to exclude the presence or addition of one or more other figures, numbers, operations, members, elements, and/or groups.

Hereinafter, embodiments of the present disclosure will be described with reference to the drawings, which schematically illustrate idealized embodiments of the present disclosure. In the drawings, variations in the illustrated geometries may be expected, for example, due to manufacturing techniques and/or tolerances. Accordingly, embodiments of the present disclosure should not be construed as limited to the specific geometry of the areas illustrated herein, but should include, for example, variations in geometry resulting from manufacturing.

The present disclosure may be primarily used in factories for manufacturing semiconductors or flat panel displays (FPDs) to transfer goods from any location to a destination. For example, the present disclosure may be used to transfer items between semiconductor (or flat panel display) manufacturing facilities. The items may include a substrate (such as a wafer). In one example, the item may be a container in which substrates are stored. Further, the container may be a sealed container capable of protecting the stored substrates from the outside. Further, the sealed container may be a front opening unified pod (FOUP). Additionally, the container may include a reticle pod for storing reticles.

While the present disclosure can be used to transport items in a variety of technical fields, embodiments of the present disclosure focus on transferring, between semiconductor manufacturing facilities, a FOUP for storing wafers in the internal space thereof as an item in a semiconductor manufacturing factory.

The semiconductor manufacturing factory may include at least one clean room, and the semiconductor manufacturing facilities in which the semiconductor manufacturing process is performed may be installed in the clean room. A semiconductor may be completed by repeatedly performing the semiconductor manufacturing process on a wafer. After the process is completed in a particular semiconductor manufacturing facility, the wafers may be transferred to a semiconductor manufacturing facility for the next process. In this case, the wafers may be transferred by an item transfer facility including an OHT while stored in the FOUP.

Figure 2:
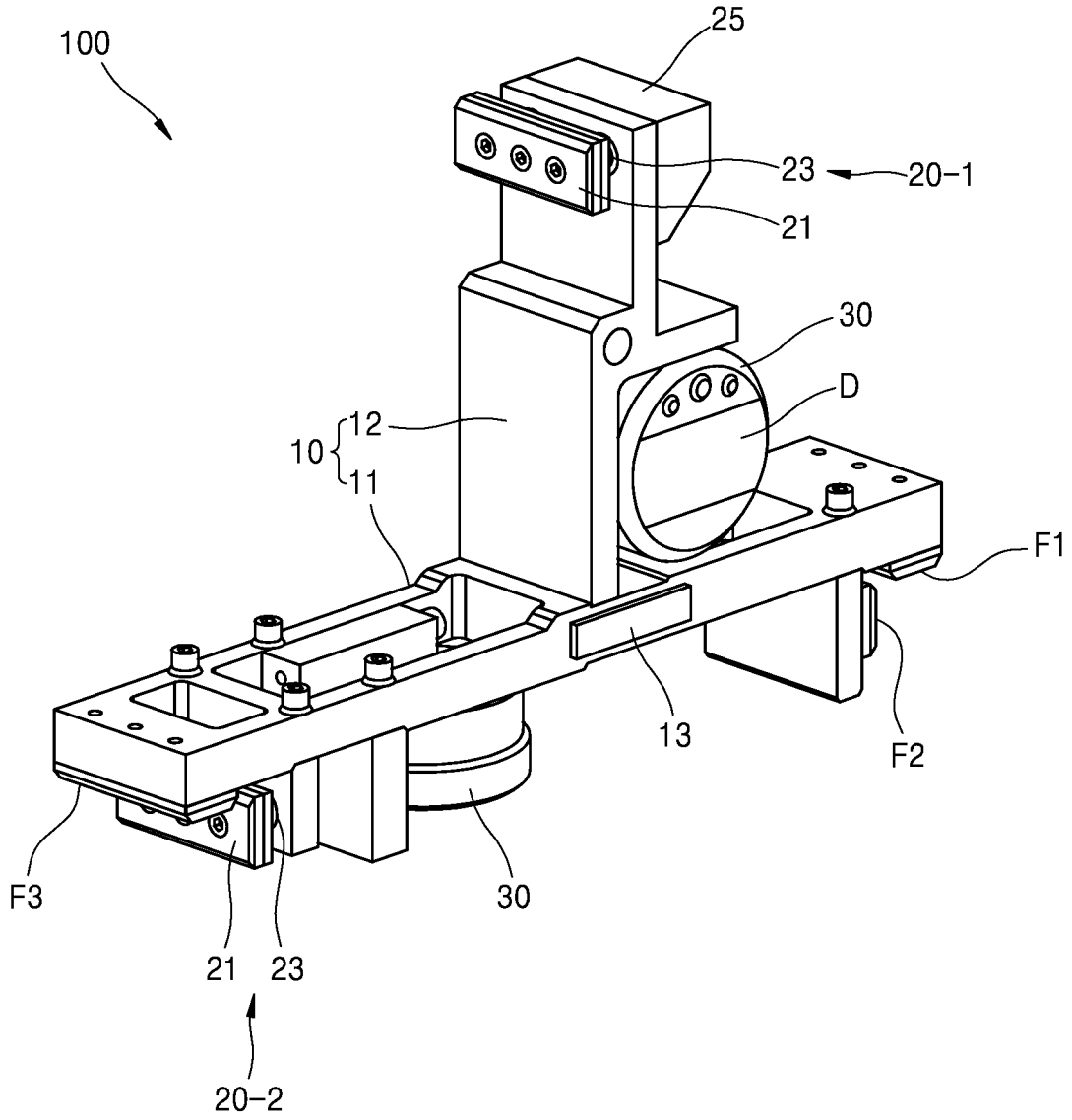
FIG. 2 is a perspective view showing the railroad measurement apparatus for a transfer vehicle of FIG. 1.
Figure 3:
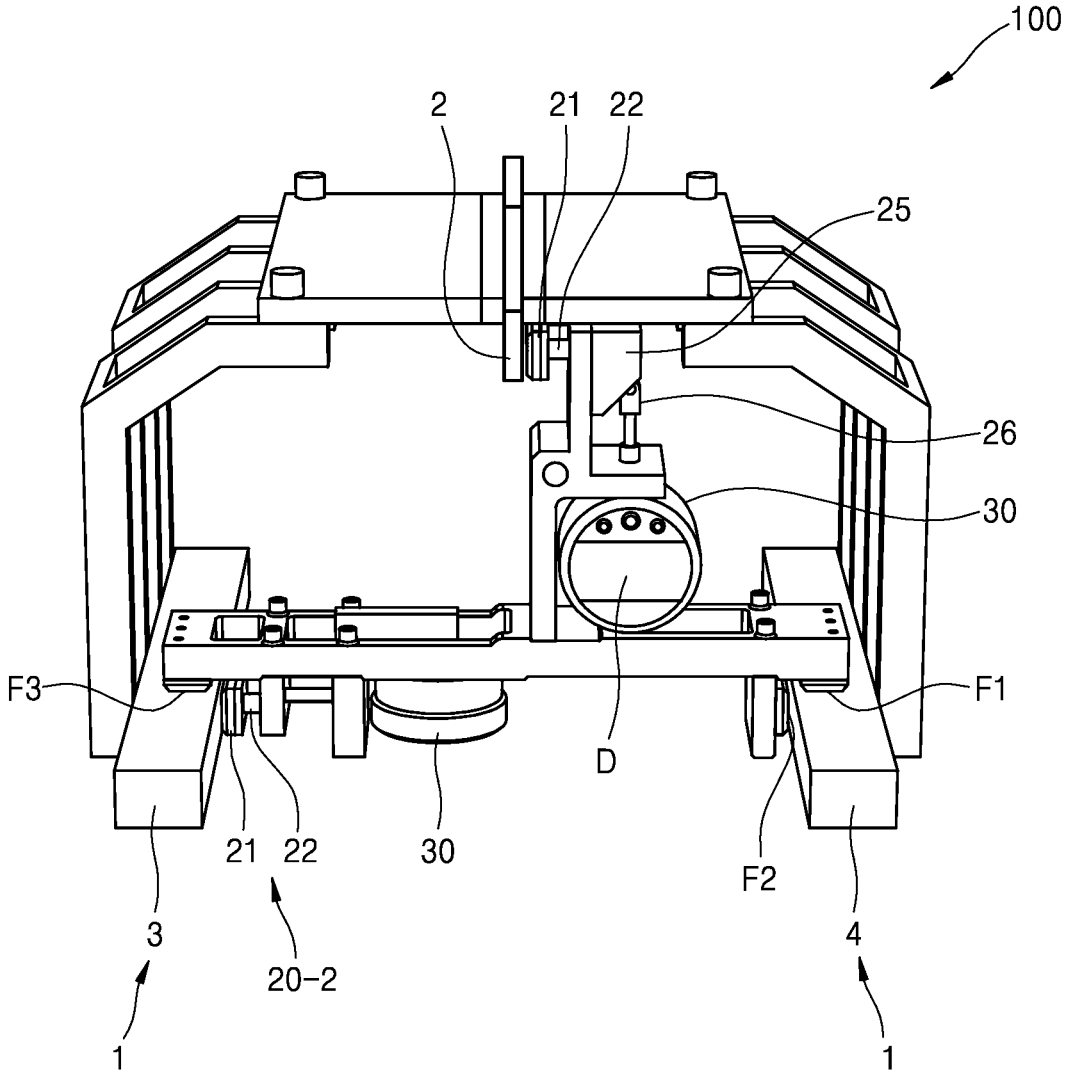
FIG. 3 is a perspective view showing a state of use of the railroad measurement apparatus for a transfer vehicle of FIG. 1.
Figure 4:
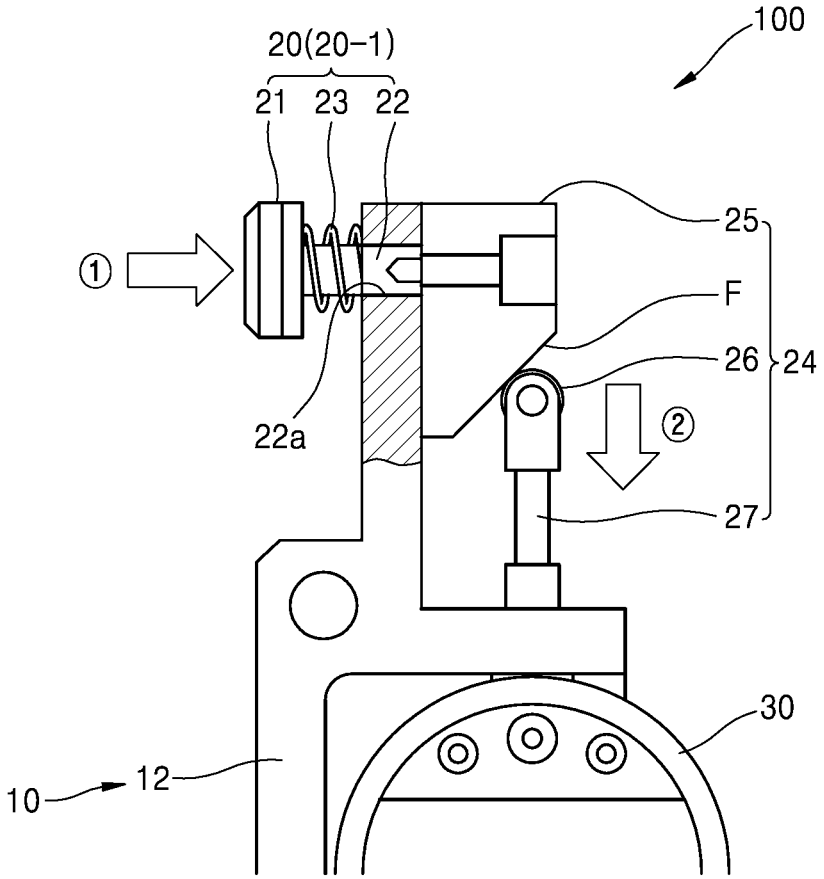
FIG. 4 is an enlarged view showing a detector of the railroad measurement apparatus for a transfer vehicle of FIG. 1.

FIG. 1 is a front view showing a railroad measurement apparatus 100 for a transfer vehicle according to some embodiments of the present disclosure, and FIG. 2 is a perspective view showing the railroad measurement apparatus 100 for a transfer vehicle of FIG. 1. FIG. 3 is a perspective view showing a state of use of the railroad measurement apparatus 100 for a transfer vehicle of FIG. 1, and FIG. 4 is an enlarged view showing a detector 20 of the railroad measurement apparatus 100 for a transfer vehicle of FIG. 1, As shown in FIGS. 1 to 4, the railroad measurement apparatus 100 for a transfer vehicle according to some embodiments of the present disclosure may include a body 10, a detector 20, and a displacement measurer 30.

The railroad measurement apparatus 100 of the present disclosure may measure the state of installation of a railroad 1 of the transfer vehicle. Here, the transfer vehicle may be a transfer vehicle of an overhead hoist transport (OHT) that is installed on the ceiling of a semiconductor factory where substrates such as display substrates or wafers may be processed.

Such an OHT is a facility for more efficiently transferring, between semiconductor manufacturing facilities, items (e.g., containers for storing wafers, front opening unified pods (FOUPs) for storing reticles, reticle pods (PODs) for storing reticles, etc.) produced by various processes (e.g., exposure, deposition, etching, ion implantation, cleaning, etc.) performed by semiconductor manufacturing facilities to improve semiconductor manufacturing efficiency. The OHT may include a travel railroad (travel line, travel rail) providing a transfer path, a transfer vehicle traveling along the railroad, and a hoist device provided to a lower portion of the transfer vehicle. The hoist device may support an item to be transferred, and the hoist may rotate the item, move the item in a horizontal direction, or raise and lower the item in a vertical direction to place the item on an item storage rack.

The railroad 1 may include at least one upper rail 2 corresponding to an upper wheel provided for steering or powering the transfer vehicle, at least one left rail 3 corresponding to a left wheel for travel of the transfer vehicle, and at least one right rail 4 corresponding to a right wheel for travel of the transfer vehicle.

The railroad 1 may be equipped with a buffer (not shown), which is one or more item storage racks providing temporary storage space for items. The railroad 1 is disposed on the ceiling side of a semiconductor manufacturing factory, and the transfer vehicle may transfer items directly from one of the semiconductor manufacturing facilities to another, or may temporarily store the items in the buffer before transferring them to another facility.

The buffer may be a side track buffer (STB) installed on a lateral side of the railroad 1 or an under track buffer (UTB) installed on a lower side of the railroad 1.

The railroad measurement apparatus 100 according to some embodiments of the present disclosure is capable of measuring the installation status of the railroad 1 along which the transfer vehicle of the OHT can be driven. The railroad 1 may measure not only the installation status of rails, but also the installation status of a power supply unit, which supplies power to the transfer vehicle, or a signal transmission unit.

Furthermore, the railroad 1 may measure not only a straight section of rail having a straight shape, but also a curved section having a curved shape connected thereto.

However, the railroad measurement apparatus 100 for the transfer vehicle of the present disclosure is not necessarily limited to the OHT, and may be applied to a wide variety of other types of railroads.

For example, the body 10 may be a sort of jig-shaped structure arranged to straddle at least a portion of the railroad 1 of the transfer vehicle, and may be formed to correspond to the railroad 1 of the transfer vehicle.

More specifically, for example, the body 10 may include a horizontal member 11 hung on the left rail 3 and the right rail 4 substantially in a horizontal position to measure an installation status of the left rail 3 and the right rail 4, and a vertical member 12 protruding upward from the horizontal member 11 in a substantially vertical position to measure an installation status of the upper rail 2.

As shown in FIGS. 1 to 4, the body 10 may be formed in an inverted T-shape with the vertical member 12 generally protruding upward from the horizontal member 11.

Here, the body 10 may be a frame structure that is formed by connecting the horizontal member 11 and the vertical member 12 with fixtures such as bolts or nuts, or is formed as an integral cast structure.

The body 10 configured as described above may be made of a material such as invar having a very low thermal conductivity or undergoing little thermal deformation, and may be made of a relatively lightweight aluminum material or the like for ease of carrying by operators.

However, the body 10 of the railroad measurement apparatus 100 for the transfer vehicle according to the present disclosure may be formed in various shapes and made of various materials for convenience, depending on the shape of the railroad 1, the shape of the transfer vehicle, a part to be measured, the measurement environment, and the like.

As shown in FIGS. 1 to 4, the detector 20, which is provided to the body 10, may be a kind of detection structure in contact with the railroad 1, which is an object to be measured.

For example, as shown in FIG. 4, the detector 20 may include a movable member 21 having a contact surface disposed in contact with the railroad 1, a guide rod 22 having a front end, a middle portion, and a rear end, wherein the front end is provided to the movable member 21, the middle portion is arranged to move back and forth in a first direction (toward the railroad 1) along a guide hole **22*a* formed in the body 10, and the rear end is connected to the displacement measurer 30, and an elastic spring 23 arranged between the movable member 21 and the body 10 to exert an elastic return force in a direction of contact between the movable member 21 and the railroad 1**.

Here, the guide rod 22 may be slidably guided by the guide hole **22*a* in a direction toward the railroad 1**. The direction may be consistent with the direction in which the measurement is performed.

For example, to measure the specification of a side of the railroad 1, the guide rod 22 may be slidably guided in a front-to-back or side-to-side direction. To measure the specification of a top surface or bottom surface of the railroad 1, the guide rod 22 may be slidably guided in a vertical direction.

However, it is also possible that the guide rod 22 is slidably guided in an inclined direction. The guide rod 22 may be slidably guided in various ways depending on the shape of the railroad 1 to be measured.

Thus, as shown in FIGS. 1 and 3, once the body 10 of the present disclosure is mounted on the railroad 1, the movable member 21 may be pressed by the elastic spring 23 toward the railroad 1 with respect to the body 10 so as to remain in contact with the railroad 1 at all times.

In this case, the position of the movable member 21 that remains in contact with the railroad 1 may reflect the installation status of the railroad 1. The installation status of the railroad 1 may always be reflected by the movable member 21 without the operator having to measure the distance between the body 10 and the railroad 1 with a separate measurement equipment. Thus, for example, when the body 10 is moved along the railroad 1, the movable member 21 may be displaced backwardly at a protruding portion of the railroad 1 or may be displaced forwardly at a depressed portion of the railroad 1, depending on the installation status of the railroad 1.

As shown in FIGS. 1 to 4, the displacement measurer 30 may be a kind of digital measuring device capable of measuring the backward and forward displacement of the detector 20 in contact with the railroad 1 and indicating the displacement in the form of a numerical value.

The displacement measurer 30 may be a device capable of measuring the changed position of the detector 20 using various distance measurement methods such as an electrical resistance value, a pressure value, an electrical conductivity value, a load, a stress, optical reflected waves, or ultrasound according to the displacement, i.e., the change in position of the detector 20, and displaying the same in the form of a digital numerical value.

Therefore, by using the displacement measurer 30, the displacement of the movable member 21, which is displaced forward and backward according to the shape of the railroad 1, may be measured. Then, depending on the degree of displacement, information indicating whether the railroad 1 is installed normally according to a predetermined specification, or whether the installation is below the predetermined specification or exceeds the predetermined specification may be identified in the form of a digitized numerical value rather than in the conventional manner of reading the scale.

Further, as shown in FIGS. 1 to 4, the detector 20 may further include a direction switcher 24 disposed between the guide rod 22 and the displacement measurer 30 and configured to switch the movement of the guide rod 22 in the first direction to movement in a second direction different from the first direction.

With the direction switcher 24, the railroad 1 may be measured in various directions, and the displacement measurer 30 may be oriented in a direction that allows an operator to visually check the digitized numerical values obtained by the measurement by the displacement measurer 30.

In a more specific example, as shown in FIG. 4, the direction switcher 24 may include an angled block 25 arranged at the rear end of the guide rod 22 to move with the guide rod 22, the angled block 25 having an inclined surface F formed on one side, a roller 26 arranged in rolling contact with the inclined surface F of the angled block 25, and a displacement measuring rod 27 disposed to rotatably support the roller 26 and connected to the displacement measurer 30.

Thus, as shown in FIG. 4, with the direction switcher 24, the displacement of the guide rod 22 in the front-to-back direction (i.e., the direction indicated by arrow 1 in FIG. 4) may be switched to the displacement of the displacement measuring rod 27 in the vertical direction (i.e., the direction indicated by arrow 2 in FIG. 4) using the inclined surface F. Thereby, the displacement measurer 30 may be installed at various positions.

Here, the inclination angle of the inclined surface F may be set to 45 degrees such that the displacement of the guide rod 22 in the front-to-back direction may be matched with the displacement of the displacement measuring rod 27 in the vertical direction in a one-to-one (1:1) correspondence manner.

However, the inclination of the inclined surface F is not necessarily limited to 45 degrees, and may be set to various angles depending on the measurement direction of the railroad 1, the measurement environment, and the like. When the inclined surface F is set to an angle other than 45 degrees, the amount of displacement according to direction switching may need to be corrected in an arithmetic progression according to the angle.

Specifically, suppose that the actual displacement of the movable member 21 is X and the digitized numerical value measured by the displacement measurer 30 is Y. Then, when the numerical value measured by the displacement measurer 30 is 2Y, the displacement of the movable member 21 may be inferred to be 2X. In other words, such a correction operation may be performed in an arithmetic progression.

However, the correction operation is limited to the arithmetic progression. For example, it may be performed exponentially, or other correction formulae such as a first-order function, second-order function, third-order function, and the like may be applied depending on the actual measurement environment or additional parameters, constants, or variables that may be considered.

As shown in FIGS. 1 to 4, the detector 20 may include a first detector 20-1 mounted on the vertical member 12 to contact a side surface 2*a* of the upper rail 2 to measure an installation status of the side surface 2*a* of the upper rail 2, and a second detector 20-2 mounted on the horizontal member 11 to contact a side surface 3*a* of the left rail 3 or a side surface 4*a* of the right rail 4 to measure an installation gap between the left rail 3 and the right rail 4.

Here, for more accurate measurements, the body 10 may have a reference surface which serves as a reference for the measurement operation of measuring the installation gap between the left and right rails.

To form the reference surface, one end of the horizontal member 11 may be provided with a first reference contact surface F1 arranged in close contact with a top surface 4*b* of the right rail 4 to serve as a reference for height measurement, and a second reference contact surface F2 arranged in close contact with the side surface 4*a* of the right rail 4 to serve as a reference for gap measurement.

In addition, to enable measurement of the horizontality, or level, between the left and right rails, an opposite end of the horizontal member 11 may be provided with a resting surface F3 resting on a top surface 3*b* of the left rail 3, and the second detector 20-2 may be disposed on a lower side of the resting surface F3.

In this case, the body 10 may further have a horizontal inclination gauge 13 arranged on the horizontal member 11 and configured to measure an inclination of the horizontal member 11 with respect to a horizontal direction according to an installation height of the left rail 3 or the right rail 4.

The horizontal inclination gauge 13 may also indicate the angle of the horizontal member 11 with respect to the horizontal direction as a digitized numerical value. In addition to the horizontal inclination gauge 13, various other types of inclination gauges may be applied.

Thus, as shown in FIGS. 1 and 3, the railroad measurement apparatus 100 for a transfer vehicle according to some embodiments of the present disclosure may be mounted on the railroad 1.

At this time, the first reference contact surface F1 formed at one end of the horizontal member 11 of the body 10 may be brought into close contact with the top surface 4*b* of the right rail 4, and the second reference contact surface F2 may be brought into close contact with the side surface 4*a* of the right rail 4.

Subsequently, first displacement information about the detector 20 at a first point may be measured in the form of digitized numerical information using the displacement measurer 30 in contact with the railroad 1.

Then, with the body 10 and the detector 20 in contact with the railroad 1, the body 10 may be moved along the railroad 1 to measure second displacement information about the detector 20 at a second point in the form of digitized numerical information.

Thus, the railroad measurement apparatus 100 according to some embodiments of the present disclosure allows an operator to very easily check digitized numerical information while pushing the body 10 to move along the railroad 1. Therefore, the installation status of the railroad or whether it conforms to the specification may be measured accurately and quickly in a very intuitive and convenient manner, and the productivity of the work may be greatly improved by reducing the measurement time. Furthermore, the installation status may be numerically measured with high precision, and the reliability and convenience of the work may be greatly improved by minimizing the measurement error among the operators. In addition, various parts may be measured using the direction switcher or the like.

Figure 5:
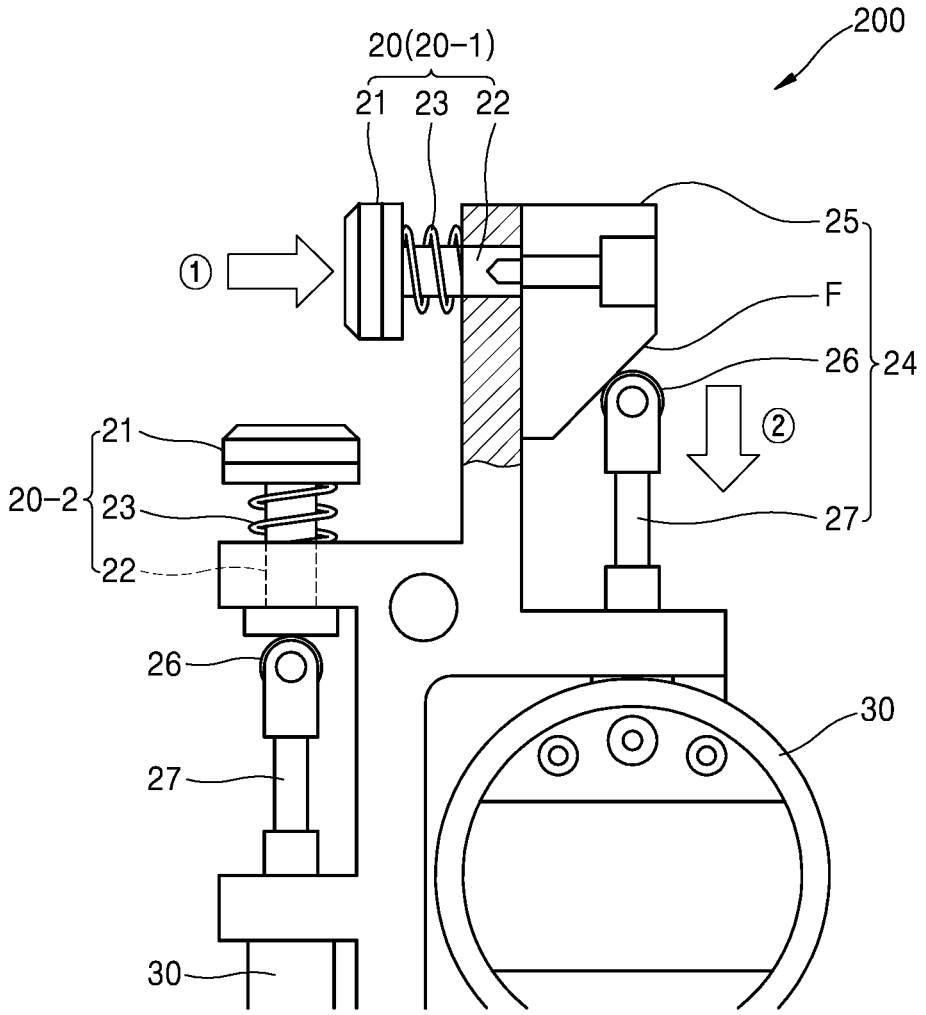
FIG. 5 is a front view showing a detector of a railroad measurement apparatus for a transfer vehicle according to some other embodiments of the present disclosure.

FIG. 5 is a front view showing the detector 200 of a railroad measurement apparatus 200 for a transfer vehicle according to some other embodiments of the present disclosure.

As shown in FIG. 5, the detector 20 of the railroad measurement apparatus 200 for a transfer vehicle according to some other embodiments of the present disclosure may further include a third detector 20-3 mounted on the vertical member 12 and disposed to contact a bottom surface 2*b* of the upper rail 2 of FIG. 1 to measure an installation status of the bottom surface 2*b* of the upper rail 2.

Thus, the installation status of the bottom surface 2*b* of the upper rail 2 for steering or power distribution may also be accurately measured using the third detector 20-3.

For example, the detectors 20 may be installed in various parts of the body 10 so as to detect all parts of the railroad 1 that need to be measured.

Figure 6:
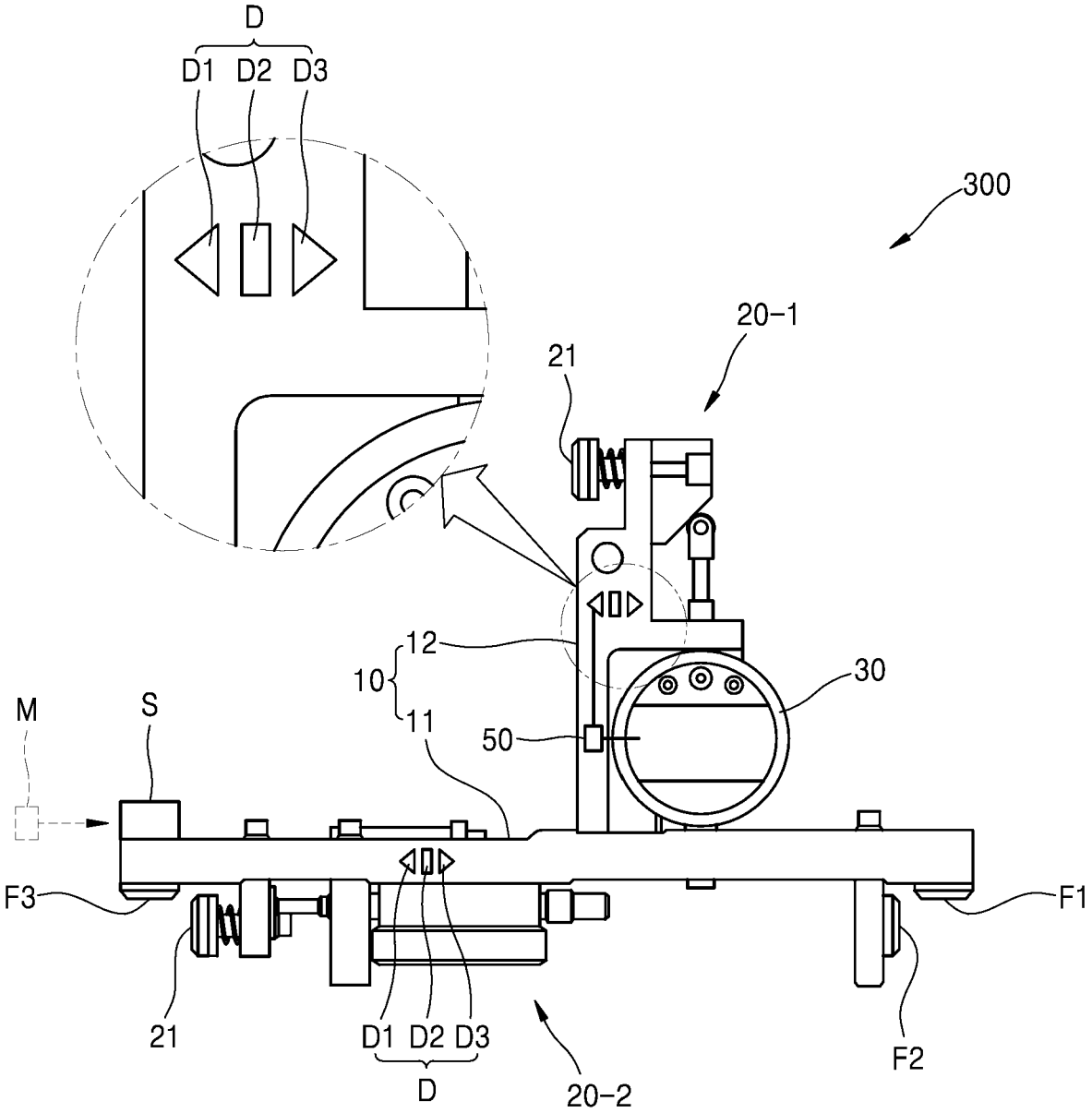
FIG. 6 is a front view showing a railroad measurement apparatus for a transfer vehicle according to some other embodiments of the present disclosure.

FIG. 6 is a front view showing a railroad measurement apparatus 300 for a transfer vehicle according to some other embodiments of the present disclosure.

As shown in FIG. 6, the railroad measurement apparatus 300 for a transfer vehicle according to some other embodiments of the present disclosure may further include a controller 50 configured to compare a value of the displacement measured by the displacement measurer 30 with a reference range, and to display a value of the displacement on a display D when the value is outside the reference range.

Here, the display D may include a below status notifier D1 configured to be activated for ease of visual checking by an operator when the value of the measured displacement is below the reference range, a normal status notifier D2 configured to be activated when the value of the measured displacement is within the reference range, and an over status notifier D3 configured to be activated when the value of the measured displacement is above the reference range.

Thus, the below status notifier D1, the normal status notifier D2, the over status notifier D3, or the like activated to allow the operators to check the status of the railroad 1 in a very intuitive manner without having to check the digitized numerical values may allow the operators to very quickly determine the installation status of the railroad 1 or take follow-up actions.

As shown in FIG. 6, the railroad measurement apparatus 300 for a transfer vehicle according to some other embodiments of the present disclosure may further include a position sensor S configured to sense a position of the railroad 1 contacted by the detector 20, and the controller 50 may match the position sensed by the position sensor S with the displacement measured by the displacement measurer 30 to store or determine a specification of the railroad 1 by position.

Here, the position sensor S may include one of at least one camera, an identification device configured to identify an identifier M on the railroad, including a bar code, a QR code, an RFID, a magnet, or a semiconductor chip, a GPS sensing device, a distance measurement wheel mounted on the body so as to be rollable in contact with the railroad and configured to sense a distance traveled from a reference point based on a diameter and a number of revolutions, a laser rangefinder configured to measure a distance using reflected laser light, or an ultrasonic rangefinder configured to measure a distance using sound waves or ultrasonic waves, or a combination thereof.

Accordingly, as shown in FIG. 6, the operator may identify the schematic installation status of the railroad 1 very intuitively and quickly using the below status notifier D1, the normal status notifier D2, or the over status notifier D3, and the measured displacement information matched to the positions on the railroad 1 may be stored for reference in subsequent actions without the need for the operator to record detailed measurements.

Figure 7:
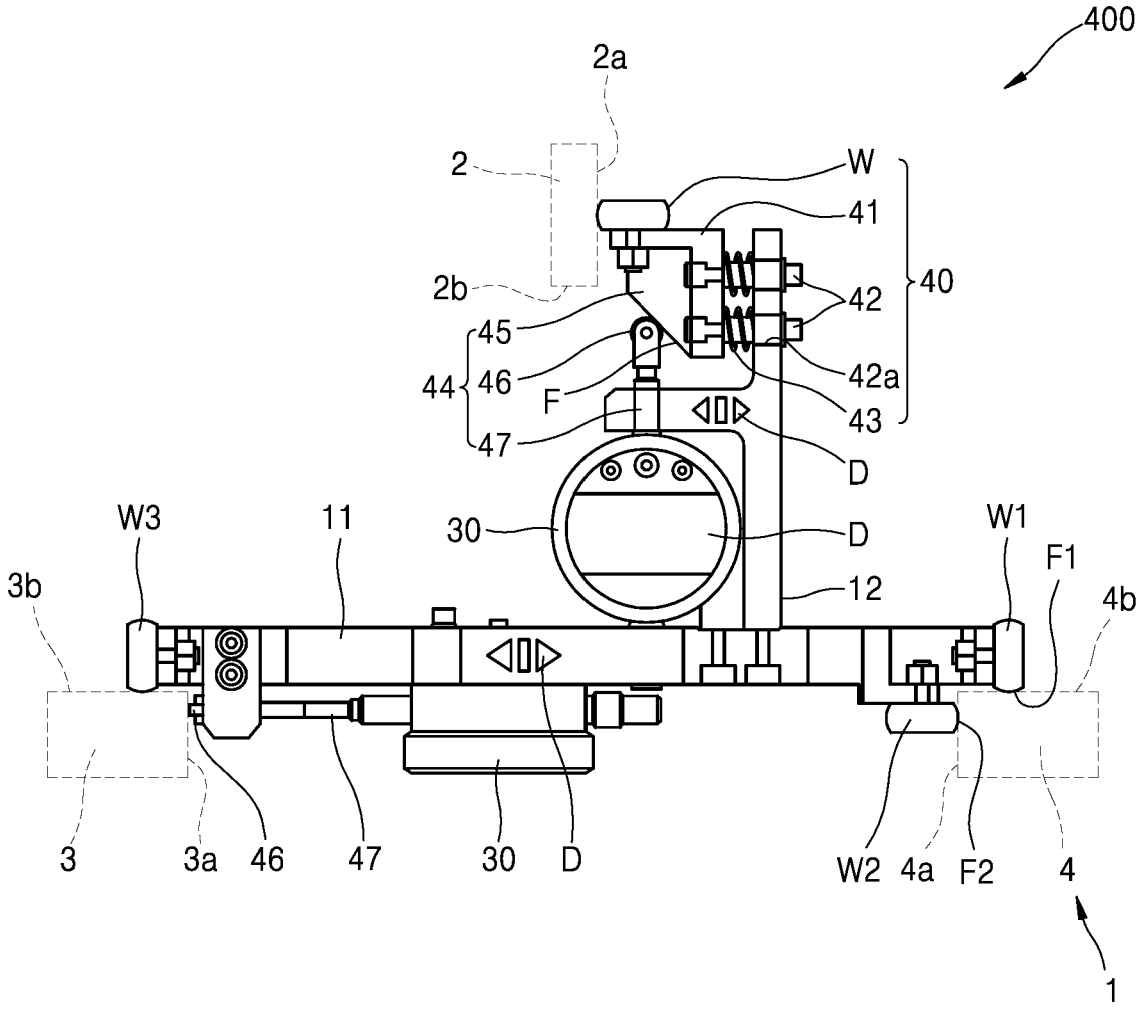
FIG. 7 is a front view showing a railroad measurement apparatus for a transfer vehicle according to some other embodiments of the present disclosure.

FIG. 7 is a front view showing a railroad measurement apparatus 400 for a transfer vehicle according to some other embodiments of the present disclosure.

As shown in FIG. 7, a detector 40 of the railroad measurement apparatus 400 for a transfer vehicle according to some other embodiments of the present disclosure may include a rolling wheel W brought into rolling contact with the railroad 1 to enable measurement of movement, a movable member 41 disposed to support the rolling wheel W while allowing for free rotation of the rolling wheel W, a guide rod 42 having a front end provided to the movable member 41, and a middle portion arranged to move back and forth in a first direction along a guide hole 42*a* formed in the body 10, and an elastic spring 43 arranged between the movable member 41 and the body 10 to exert an elastic return force in a direction of contact between the rolling wheel W and the railroad.

In addition, for example, the detector 40 may further include a direction switcher 44 disposed between the movable member 41 and the displacement measurer 30 to switch movement of the movable member 41 in the first direction to movement in a second direction different from the first direction.

Here, the direction switcher 44 may include an angled block 45 arranged on the movable member 41 to move with the movable member 41, the angled block 45 having an inclined surface F formed on one side, a roller 46 arranged in rolling contact with the inclined surface F of the angled block 45, and a displacement measuring rod 47 disposed to rotatably support the roller 46 and connected to the displacement measurer 30.

Here, for example, one end of the horizontal member 11 of the body 10 may be provided with a first reference wheel W1 arranged in close contact with a top surface 4*b* of the right rail 4 to serve as a reference for height measurement, and a second reference wheel W2 arranged in close contact with a side surface 4*a* of the right rail 4 to serve as a reference for gap measurement.

Also, for example, an opposite end of the horizontal member 11 may be provided with a resting wheel W3 resting on the top surface 3*b* of the left rail 3.

Thus, as shown in FIG. 7, the railroad measurement apparatus 400 for a transfer vehicle according to some other embodiments of the present disclosure may be mounted on the railroad 1 and easily moved using the wheels W, W1, W2, and W3.

At this time, the first reference wheel W1 provided at one end of the horizontal member 11 of the body 10 may be brought into close contact with the top surface 4*b* of the right rail 4. The second reference wheel W2 may be brought into close contact with the side surface 4*a* of the right rail 4, and the resting wheel W3 may be rested on the top surface 3*b* of the left rail 3. Thus, the body 10 may be moved by rolling.

Subsequently, first displacement information about the detector 40 at a first point may be measured in the form of digitized numerical information using the displacement measurer 30 in contact with the railroad 1.

Then, while the body 10 and the detector 20 in contact with the railroad 1, the body may be easily along the railroad 1 moved using the wheels W, W1, W2, and W3 to measure second displacement information about the detector 40 at a second point in the form of digitized numerical information.

Thus, the railroad measurement apparatus 400 according to some embodiments of the present disclosure allows an operator to very easily check digitized numerical information while pushing the body 10 using the wheels W, W1, W2, and W3 to move along the railroad 1. Therefore, the installation status of the railroad or whether it conforms to the specification may be measured accurately and quickly in a very intuitive and convenient manner, and the productivity of the work may be greatly improved by reducing the measurement time. Furthermore, the installation status may be numerically measured with high precision, and the reliability and convenience of the work may be greatly improved by minimizing the measurement error among the operators. In addition, various parts may be measured using the direction switcher or the like. In addition, friction may be reduced by using wheels, thereby improving mobility and convenience.

Figure 8:
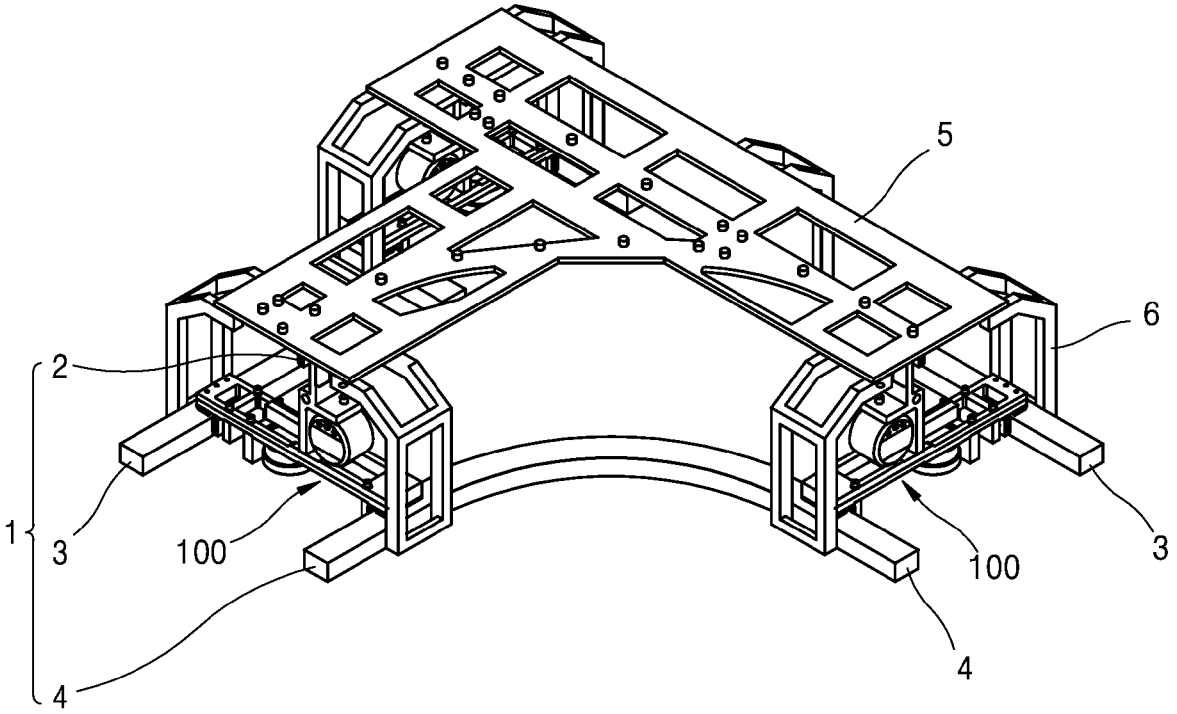
FIG. 8 is a perspective view showing a railroad measurement state of the railroad measurement apparatus for a transfer vehicle of FIG. 1.

FIG. 8 is a perspective view showing a railroad measurement state of the railroad measurement apparatus 100 for a transfer vehicle of FIG. 1

As shown in FIG. 8, the railroad 1 may include at least one upper rail 2 corresponding to an upper wheel provided for steering or powering the transfer vehicle, at least one left rail 3 corresponding to a left wheel for travel of the transfer vehicle, and at least one right rail 4 corresponding to a right wheel for travel of the transfer vehicle, and may include not only a straight section but also a curved section.

The railroad 1 may be installed on a ceiling panel 5 in a semiconductor factory. A support structure 6 may be provided to connect and support the upper rail 2 and the left and right rails with each other, as necessary.

Accordingly, the transfer vehicle may travel along the railroad 1 providing a transfer path for transferring items between semiconductor manufacturing facilities.

The railroad measurement apparatus 100 for the transfer vehicle according to various embodiments of the present disclosure may be mounted on the railroad 1 and easily moved along the railroad 1, allowing an operator to easily measure and determine whether the installation of the railroad 1 is normal or abnormal at a particular location using very immediately digitized numerical values or a display.

Figure 9:
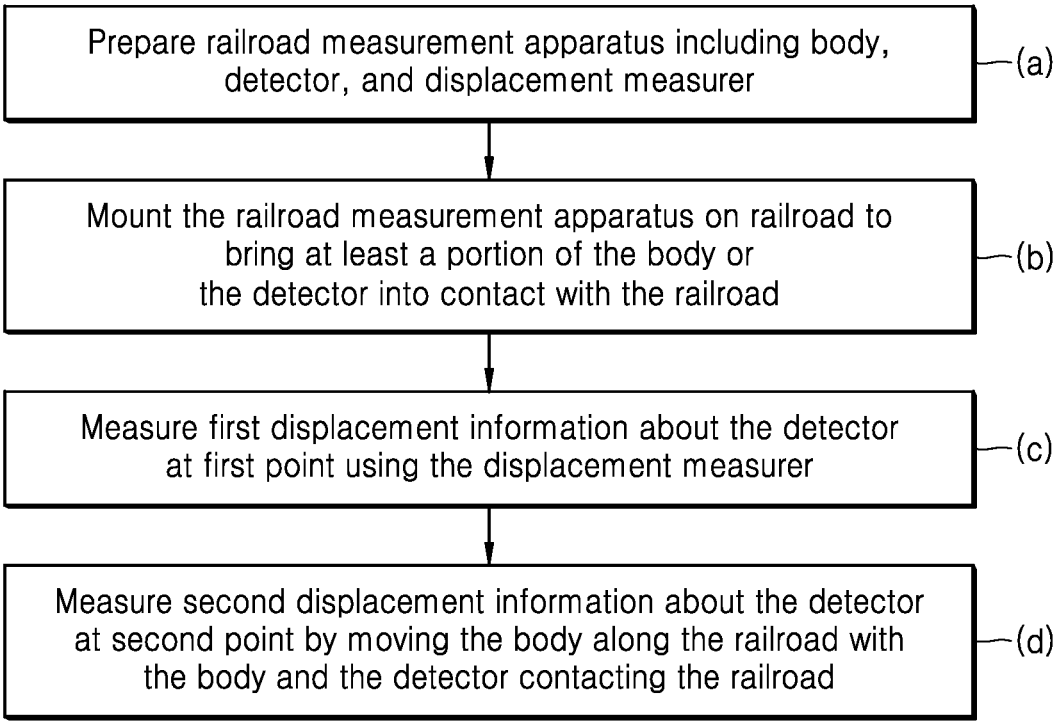
FIG. 9 is a flowchart illustrating a method of measuring a railroad of a transfer vehicle according to some embodiments of the present disclosure.

FIG. 9 is a flowchart illustrating a method of measuring a railroad of a transfer vehicle according to some embodiments of the present disclosure.

As shown in FIGS. 1 to 9, a method of measuring a railroad of a transfer vehicle according to some embodiments of the present disclosure may include (a) preparing the railroad measurement apparatus 100 for the transfer vehicle, including the body 10 formed in correspondence with the railroad 1 of the transfer vehicle, the detector 20 provided to the body 10 and arranged in contact with the railroad 1, and the displacement measurer 30 configured to measure the displacement of the detector 20 in contact with the railroad 1, (b) mounting the railroad measurement apparatus 100 on the railroad 1 to bring at least a portion of the body 10 or the detector 20 into contact with the railroad 1, (c) measuring first displacement information about the detector 20 at a first point using the displacement measurer 30, and (d) measuring second displacement information about the detector 20 at a second point by moving the body 10 along the railroad 1 with the body 10 and the detector 20 contacting the railroad 1.

Here, the measuring of the second displacement information may include moving the body 10 along the railroad 1 using at least one wheel W, W1, W2, or W3 provided to the body 10.

As is apparent from the above description, the present disclosure provides the following effects.

According to the various embodiments of the present disclosure described above, the installation status or the specification of the railroad may be accurately and quickly measured in a very intuitive and convenient manner using digitized numerical values or a display facilitating identification while moving an apparatus mounted on rails along a railroad, and the productivity of the work may be greatly improved by reducing the measurement time Furthermore, the installation status may be numerically measured with high precision, and the reliability and convenience of the work may be greatly improved by minimizing the measurement error among the operators. In addition, various parts may be measured using the direction switcher or the like. In addition, friction may be reduced by using wheels, thereby improving mobility and convenience. Of course, the scope of the present disclosure is not limited by these effects.

Although the present disclosure has been described with reference to the embodiments shown in the drawings, these are exemplary only, and those of ordinary skill in the art will appreciate that various modifications and other equivalent embodiments are possible. Therefore, the true scope of the present disclosure should be defined by the appended claims of the present disclosure.

What is claimed is:

1. An apparatus for measuring a railroad of a transfer vehicle, comprising:

a body formed in correspondence with a railroad of the transfer vehicle and provided with a guide hole penetrating a portion of the body;

a detector provided to the body and arranged in contact with the railroad, wherein a part of the detector is inserted into the guide hole of the body; and a displacement measurer configured to measure a displacement of the detector in contact with the railroad, wherein the detector comprises:

a movable member having a contact surface disposed in contact with the railroad;

a guide rod inserted in the guide hole and connected to the movable member and the displacement measurer, respectively; and an elastic spring disposed in a space between the guide hole and the movable member and opposite ends of the elastic spring contacting the movable member and the portion of the body, respectively.

2. The apparatus of claim 1, wherein the guide rod includes a front end, a middle portion, and a rear end, wherein the front end is connected to the movable member, the middle portion is arranged to move back and forth in a first direction along the guide hole formed in the body, and the rear end is connected to the displacement measurer, and wherein the elastic spring is configured to exert an elastic return force in a direction of contact between the movable member and the railroad.

3. The apparatus of claim 2, wherein the detector further comprises:

a direction switcher disposed between the guide rod and the displacement measurer and configured to switch movement of the guide rod in the first direction to movement in a second direction different from the first direction.

4. The apparatus of claim 3, wherein the direction switcher comprises:

an angled block arranged at the rear end of the guide rod to move with the guide rod, the angled block having an inclined surface formed on one side;

a roller arranged in rolling contact with the inclined surface of the angled block; and a displacement measuring rod disposed to rotatably support the roller and connected to the displacement measurer.

5. The apparatus of claim 1, wherein the transfer vehicle is a vehicle of an overhead hoist transport (OHT), wherein the railroad comprises:

at least one upper rail corresponding to an upper wheel of the transfer vehicle;

at least one left rail corresponding to a left wheel of the transfer vehicle; and at least one right rail corresponding to a right wheel of the transfer vehicle.

6. The apparatus of claim 5, wherein the body comprises:

a horizontal member hung on the left rail and the right rail in a substantially horizontal position to measure an installation status of the left rail and the right rail; and a vertical member protruding upward from the horizontal member in a substantially vertical position to measure an installation status of the upper rail.

7. The apparatus of claim 6, wherein the detector comprises:

a first detector mounted on the vertical member to contact a side surface of the upper rail to measure an installation status of the side surface of the upper rail; and a second detector mounted on the horizontal member to contact a side surface of the left rail or a side surface of the right rail to measure an installation gap between the left rail and the right rail.

8. The apparatus of claim 7, wherein one end of the horizontal member is provided with:

a first reference contact surface arranged in close contact with a top surface of the right rail to serve as a reference for height measurement; and a second reference contact surface arranged in close contact with the side surface of the right rail or the left rail to serve as a reference for gap measurement, wherein an opposite end of the horizontal member is provided with a resting surface resting on a top surface of the left rail or the right rail, wherein the second detector is disposed on a lower side of the resting surface.

9. The apparatus of claim 8, further comprising:

a horizontal inclination gauge arranged on the horizontal member and configured to measure an inclination of the horizontal member with respect to a horizontal direction according to an installation height of the left rail or the right rail.

10. The apparatus of claim 7, wherein the detector further comprises:

a third detector mounted on the vertical member and disposed to contact a bottom surface of the upper rail to measure an installation status of the bottom surface of the upper rail.

11. The apparatus of claim 1, wherein the detector comprises:

a rolling wheel brought into rolling contact with the railroad to enable measurement of movement;

a movable member disposed to support the rolling wheel while allowing for free rotation of the rolling wheel;

a guide rod having a front end provided to the movable member and a middle portion arranged to move back and forth in a first direction along a guide hole formed in the body; and an elastic spring arranged between the movable member and the body to exert an elastic return force in a direction of contact between the rolling wheel and the railroad.

12. The apparatus of claim 11, wherein the detector further comprises:

a direction switcher disposed between the movable member and the displacement measurer to switch movement of the movable member in the first direction into movement in a second direction different from the first direction, wherein the direction switcher comprises:

an angled block arranged on the movable member to move with the movable member, the angled block having an inclined surface formed on one side;

a roller arranged in rolling contact with the inclined surface of the angled block; and a displacement measuring rod disposed to rotatably support the roller and connected to the displacement measurer.

13. The apparatus of claim 11, wherein one end of the horizontal member of the body is provided with:

a first reference wheel arranged in close contact with a top surface of a right rail or a left rail to serve as a reference for height measurement; and a second reference wheel arranged in close contact with a side surface of the right rail or the left rail to serve as a reference for gap measurement, wherein an opposite end of the horizontal member is provided with a resting wheel resting on the top surface of the left rail or the right rail.

14. The apparatus of claim 1, further comprising:

a controller configured to compare a value of the displacement measured by the displacement measurer with a reference range and to display the value of the displacement on a display when the value is outside the reference range.

15. The apparatus of claim 14, wherein the display comprises:

a below status notifier configured to be activated for ease of visual checking by an operator when the value of the measured displacement is below the reference range;

a normal status notifier configured to be activated when the value of the measured displacement is within the reference range; and an over status notifier configured to be activated when the value of the measured displacement is above the reference range.

16. The apparatus of claim 14, further comprising:

a position sensor configured to sense a position of the railroad contacted by the detector, wherein the controller matches the position sensed by the position sensor with the displacement measured by the displacement measurer.

17. The apparatus of claim 16, wherein the position sensor comprises one of at least one camera, an identification device configured to identify an identifier on the railroad, including a bar code, a QR code, an RFID, a magnet, or a semiconductor chip, a GPS sensing device, a distance measurement wheel mounted on the body so as to be rollable in contact with the railroad and configured to sense a distance traveled from a reference point based on a diameter and a number of revolutions, a laser rangefinder configured to measure a distance using reflected laser light, or an ultrasonic rangefinder configured to measure a distance using sound waves or ultrasonic waves, or a combination thereof.

18. An apparatus for measuring a railroad of a transfer vehicle, comprising:

a body formed in correspondence with a railroad of the transfer vehicle;

a detector provided to the body and arranged in contact with the railroad; and a displacement measurer configured to measure a displacement of the detector in contact with the railroad, wherein the detector comprises:

a movable member having a contact surface disposed in contact with the railroad;

a guide rod having a front end, a middle portion, and a rear end, wherein the front end is provided to the movable member, the middle portion is arranged to move back and forth in a first direction along a guide hole formed in the body, and the rear end is connected to the displacement measurer;

an elastic spring arranged between the movable member and the body to exert an elastic return force in a direction of contact between the movable member and the railroad; and a direction switcher disposed between the guide rod and the displacement measurer and configured to switch movement of the guide rod in the first direction to movement in a second direction different from the first direction, wherein the direction switcher comprises:

an angled block arranged at the rear end of the guide rod to move with the guide rod, the angled block having an inclined surface formed on one side;

a roller arranged in rolling contact with the inclined surface of the angled block; and a displacement measuring rod disposed to rotatably support the roller and connected to the displacement measurer, wherein the transfer vehicle is a transfer vehicle of an overhead hoist transport (OHT), wherein the railroad comprises:

at least one upper rail corresponding to an upper wheel of the transfer vehicle;

at least one left rail corresponding to a left wheel of the transfer vehicle; and at least one right rail corresponding to a right wheel of the transfer vehicle, wherein the body comprises:

a horizontal member hung on the left rail and the right rail in a substantially horizontal position to measure an installation status of the left rail and the right rail; and a vertical member protruding upward from the horizontal member in a substantially vertical position to measure an installation status of the upper rail, wherein the detector comprises:

a first detector mounted on the vertical member to contact a side surface of the upper rail to measure an installation status of the side surface of the upper rail; and a second detector mounted on the horizontal member to contact a side surface of the left rail or a side surface of the right rail to measure an installation gap between the left rail and the right rail, wherein one end of the horizontal member is provided with:

a first reference contact surface arranged in close contact with a top surface of the right rail to serve as a reference for height measurement; and a second reference contact surface arranged in close contact with the side surface of the right rail or the left rail to serve as a reference for gap measurement, wherein an opposite end of the horizontal member is provided with a resting surface resting on a top surface of the left rail or the right rail, and wherein the second detector is disposed on a lower side of the resting surface.

* * * * *